US010226086B2

(12) United States Patent
Saladino

(10) Patent No.: US 10,226,086 B2
(45) Date of Patent: Mar. 12, 2019

(54) APPAREL WITH RETRACTABLE EXTENSIONS

(71) Applicant: Gregory J. Saladino, Cardiff, CA (US)

(72) Inventor: Gregory J. Saladino, Cardiff, CA (US)

( * ) Notice: Subject to any disclaimer, the term of this patent is extended or adjusted under 35 U.S.C. 154(b) by 703 days.

(21) Appl. No.: 14/452,380

(22) Filed: Aug. 5, 2014

(65) Prior Publication Data

US 2014/0345029 A1 Nov. 27, 2014

Related U.S. Application Data

(63) Continuation-in-part of application No. 13/507,389, filed on Jun. 25, 2012.

(60) Provisional application No. 61/862,145, filed on Aug. 5, 2013.

(51) Int. Cl.

| | |
|---|---|
| ***A42C 5/02*** | (2006.01) |
| ***A41B 7/00*** | (2006.01) |
| ***A41B 1/00*** | (2006.01) |
| ***A41D 15/00*** | (2006.01) |
| ***A42B 1/20*** | (2006.01) |

(52) U.S. Cl.

CPC ..... *A41D 15/002* (2013.01); *A42B 1/206* (2013.01); *A41D 2200/20* (2013.01)

(58) Field of Classification Search

CPC ..... A41D 1/04; A41D 15/002; A41D 15/005; A41D 15/007; A41D 15/02; A41D 15/04; A41F 11/12; A41F 19/00; A41F 19/005; A41F 17/02; A41F 15/02; A41B 1/04; A42B 1/206

USPC .... 2/128, 181, 141, 124, 118, 119, 271, 269

See application file for complete search history.

(56) References Cited

U.S. PATENT DOCUMENTS

| | | | | |
|---|---|---|---|---|
| 2,615,168 | A | 10/1952 | Tannenbaum | |
| 3,750,192 | A | 8/1973 | Beresic | |
| 3,765,031 | A | 10/1973 | Beresic | |
| 4,302,850 | A * | 12/1981 | Maeshima | A41D 27/10 2/102 |
| RE30,899 | E | 4/1982 | Kallman | |
| 4,689,831 | A * | 9/1987 | Greenberger | A45F 4/12 2/108 |
| 4,773,101 | A * | 9/1988 | Kapp | A41B 13/08 2/69.5 |
| 5,105,475 | A | 4/1992 | Lynd et al. | |
| 5,369,809 | A * | 12/1994 | Hall | A41D 3/00 2/202 |

(Continued)

FOREIGN PATENT DOCUMENTS

KR 20-0239252 Y1 10/2001

OTHER PUBLICATIONS

Frontline Hat™. Style# 82045OR. Website: http://www.outdoorresearch.com/en/frostline-hat.htm. [Retrieved Oct. 2, 2014].

(Continued)

*Primary Examiner* — Timothy K Trieu

(74) *Attorney, Agent, or Firm* — Mintz Levin Cohn Ferris Glovsky and Popeo, P.C.

(57) ABSTRACT

Apparel in which retractable extensions from a body portion can be selectively engaged in to cover the wearer's face, head, arms or legs. The extension of material is connected to the body portion, and stored within a pocket when it is not in use. When it is needed the wearer reaches into the pocket, and extends the material out of the pocket, engaging it as a useful sleeve, pant leg, face covering, or hood.

14 Claims, 12 Drawing Sheets

(56) References Cited

U.S. PATENT DOCUMENTS

| | | | | |
|---|---|---|---|---|
| 5,539,929 | A | 7/1996 | Revson | |
| 5,713,077 | A | 2/1998 | Humbrecht | |
| 5,815,832 | A | 10/1998 | Skolik | |
| 5,860,165 | A | 1/1999 | Cvijanovich | |
| 5,894,604 | A | 4/1999 | Crabb et al. | |
| 5,926,854 | A | 7/1999 | Grilliot et al. | |
| 5,933,871 | A | 8/1999 | Kraft | |
| 6,170,087 | B1 | 1/2001 | Brannon | |
| 7,240,372 | B2 | 7/2007 | Larson | |
| 7,260,850 | B2 | 8/2007 | Ambuske et al. | |
| 7,690,052 | B2 | 4/2010 | Saladino | |
| 8,001,624 | B1 | 8/2011 | Leedom | |
| 9,364,040 | B2 | 6/2016 | Saladino | |
| 9,512,873 | B2 | 12/2016 | Oguma et al. | |
| 2006/0117450 | A1 | 6/2006 | Matsumoto | |
| 2008/0250538 | A1 | 10/2008 | Saladino | |
| 2009/0019616 | A1* | 1/2009 | Smith | A41D 13/02 2/51 |
| 2009/0210995 | A1 | 8/2009 | Kwon et al. | |
| 2011/0185482 | A1 | 8/2011 | Godfrey et al. | |
| 2011/0252547 | A1 | 10/2011 | Leung et al. | |
| 2012/0060259 | A1 | 3/2012 | Falken | |
| 2013/0340142 | A1 | 12/2013 | Saladino | |

OTHER PUBLICATIONS

International Search Report issued in International Application No. PCT/US2013/047160, dated Oct. 4, 2013.

* cited by examiner

APPAREL WITH RETRACTABLE EXTENSIONS

CROSS-REFERENCE TO RELATED APPLICATIONS

This application is a continuation-in-part of U.S. patent application Ser. No. 13/507,389, titled "Headwear With Storable Accessory," filed Jun. 25, 2012; and claims priority to U.S. Provisional Patent Application Ser. No. 61/862,145, titled "Apparel With Retractable Extensions," filed Aug. 5, 2013. The disclosures of the aforementioned applications are hereby incorporated by reference, each in its entirety.

FIELD OF THE INVENTION

The methods, apparatus, and systems described herein relate generally to an article of apparel, and more specifically to an article of apparel in which a retractable extension from a body portion can be selectively utilized to cover the wearer's face, head, arms, or legs.

BACKGROUND OF THE INVENTION

It is typical, that when wearing outerwear, the user would prefer to have the choice of removing portions of his clothing, or adding portions, depending on the weather or the time or day. For example, in the early morning, he may leave the house with a full jacket, where the sleeves are present. As the day goes on, and the sun shines brighter and the heat rises, he may prefer to not have sleeves. In typical designs, it is common practice to un-zip or unbutton the sleeves from a main body portion. The wearer then has to store the sleeves somewhere not on the main body, making it quite common for the wearer to lose the sleeves. As the day goes on, he may begin to get cold again. He therefore has to find where he put the sleeves, and reattach the sleeves to the main body portion. It is typical that the reattaching of the sleeves by buttoning or zipping them to the body can be difficult, time consuming, and frustrating. The zippers or the button snaps have to line up exactly, taking more than a few minutes. The same scenario is relevant to the use of pants with removable legs, jackets with removable hoods, or hoods with removable bandannas.

It is an object of the methods, apparatus, and systems described herein to provide a jacket or shirt, which has retractable sleeves, which when retracted, remain in a storage region within the main body of the article of apparel.

It is also an object of the methods, apparatus, and systems described herein to provide an item of headwear, which has a retractable face covering, which when retracted, remains in a storage region within the main body of the headwear.

It is further an object of the methods, apparatus, and systems described herein to provide a jacket, which has a retractable hood, which when retracted, also remains in a storage region within the main jacket.

It is yet a further object of the methods, apparatus, and systems described herein, to provide shorts, which have a retractable pant leg, which when retracted, remain in a storage region within the main body of the shorts.

SUMMARY OF THE INVENTION

To these ends, the methods, apparatus, and systems described herein are directed to items of apparel in which an extension of material from a main body is stored in a first position where it remains in a storage region. It is then placed in a second open position, where the excess material of the main article is used as an extension of the main body. A retention mechanism is attached to the extension of material and then passes through a region in the main body portion, so that when the retention mechanism is pulled through the area of the main body portion, the extended material moves from its second open position, back to its first stored position, within the storage region.

The main body portion may consist of a hood or a hat with an extended face covering. It may consist of shorts and extended material in the form of pant legs. It may also be in the form of a jacket or shirt, wherein the extension extends from the neck area up and over one's head to form a hood. In another aspect of the articles of apparel described herein, the main body portion may be a vest, wherein the extended material is present in the form of sleeves that extend from the storage region and cover one's arms, forming a full jacket.

In some embodiments, an article of apparel is provided that includes a body portion having a storage region and an extension normally positioned in a first, open position; and retention means operably secured to said extension and being effective when manually pulled to move said extension from its said first position to a second, storage position within said storage region. The article of apparel may include embodiments in which the body portion is an article of headwear. Additionally, or alternatively, the article of apparel may include embodiments in which the retention means include a string.

In a related aspect, an article of apparel is provided in some embodiments that may include a body portion having a storage region formed therein and an extension normally positioned in a first, open position, and means operably secured to said extension and passing through a region of said body portion, said retention means being effective when manually pulled to move said extension from its said first position to a second position within said storage region.

The following features may be present in the article of apparel in any suitable combination. The body portion may be an article of headwear and said extension is a face covering in some embodiments. In such embodiments, the headwear may be a hood. The retention means may include a string attached to an end of said extension. Alternatively, or additionally, the retention means may include a band that can be transformed into a string. In some embodiments, the article may be a jacket and said extension is a sleeve. In some other embodiments, the article may be a pair of shorts and said extension is a pant leg.

In some embodiments, headwear having a storage region and extension normally stored in a first stored position within said storage region, and means operably secured to said extension for moving, when manually engaged, said extension from its said first position to a second, engaged position across the wearer's face and a means provided for separably attaching said extension at a location on an alternate side of the headwear may be provided.

Further, in some embodiments, a jacket having a storage region, a hood normally stored in said storage region, and means operably secured to said hood to move, when manually engaged, said hood from its said first position to a second position over the wearer's head and means provided for separably attaching said hood at a position on an alternate location on the jacket may be provided.

In another related aspect, provided in some embodiments may be an article of apparel having a storage region and an extension normally in a first, exposed position, said extension having a normally secured opening through which an appendage passes, and manually operable means operably secured to said extension for moving said extension from its said first position to a second, stored position within said storage region. In such embodiments, the extension may include a sleeve of a jacket or shirt. Conversely, or additionally, the extension may be a pant leg of a pair of shorts.

Another related aspect may be provided in some embodiments in which an article of apparel may have a body, a storage region formed in said body, and an extension normally positioned in a first, exposed position and a normally secured opening that allows an appendage of said wearer to pass through said opening, and manually operable retention means operably secured to said appendage for moving said extension from its said first position to a second storage position within said storage region, said retention means passing through a second opening in said body. In such embodiments, the extension may include a sleeve of a jacket or shirt. Conversely, or additionally, the extension may be a pant leg of a pair of shorts. The extension may be a mask extending from an item of headwear in some such embodiments. Alternatively, or additionally, the extension may be a hood extending from a jacket.

In some embodiments, an article of apparel may be provided that has a storage region and an extension stored in a first position within said storage region, and means operably secured to said extension for moving said extension to a second exposed external to the article and for then returning said extension to its said first position by manually grabbing said extension from inside the article. In such embodiments, the extension may include a sleeve of a jacket or shirt. Conversely, or additionally, the extension may be a pant leg of a pair of shorts.

Provided in some embodiments may be a self-storing pocket on an article of clothing having a main body portion, said pocket being formed when a retention mechanism operably secured to an extension of material extending from said main body portion is moved through an area on said main body portion, thereby causing said extension to fold into itself. In such embodiments, the extension may be a mask extending from an item of headwear. The extension may be a hood extending from a jacket; the extension may be a sleeve extending from a jacket. In some embodiments, the extension may be a pant leg extending from a pair of shorts.

BRIEF DESCRIPTION OF THE DRAWINGS

To the accomplishment of the above and to such further objects as may hereinafter appear, the methods, apparatus, and systems described herein relate to an article of apparel and an associated extension of the article, substantially as defined in the appended claims and as described in the following specification of several embodiments as considered in conjunction with the accompanying drawings, in which:

DETAILED DESCRIPTION OF PREFERRED EMBODIMENTS

Figure 1:
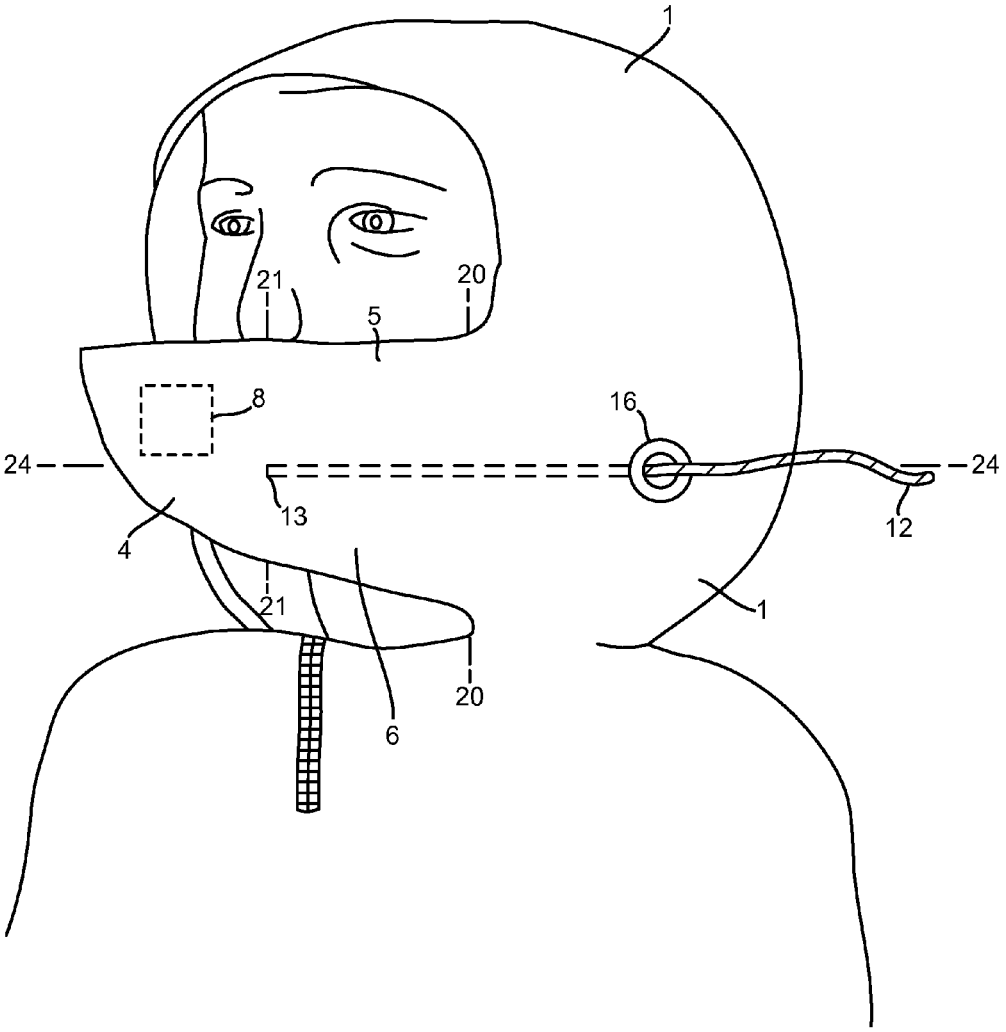
FIGS. 1-4 illustrates a side elevation of an embodiment of an item of headwear and its extended material.
Figure 2:
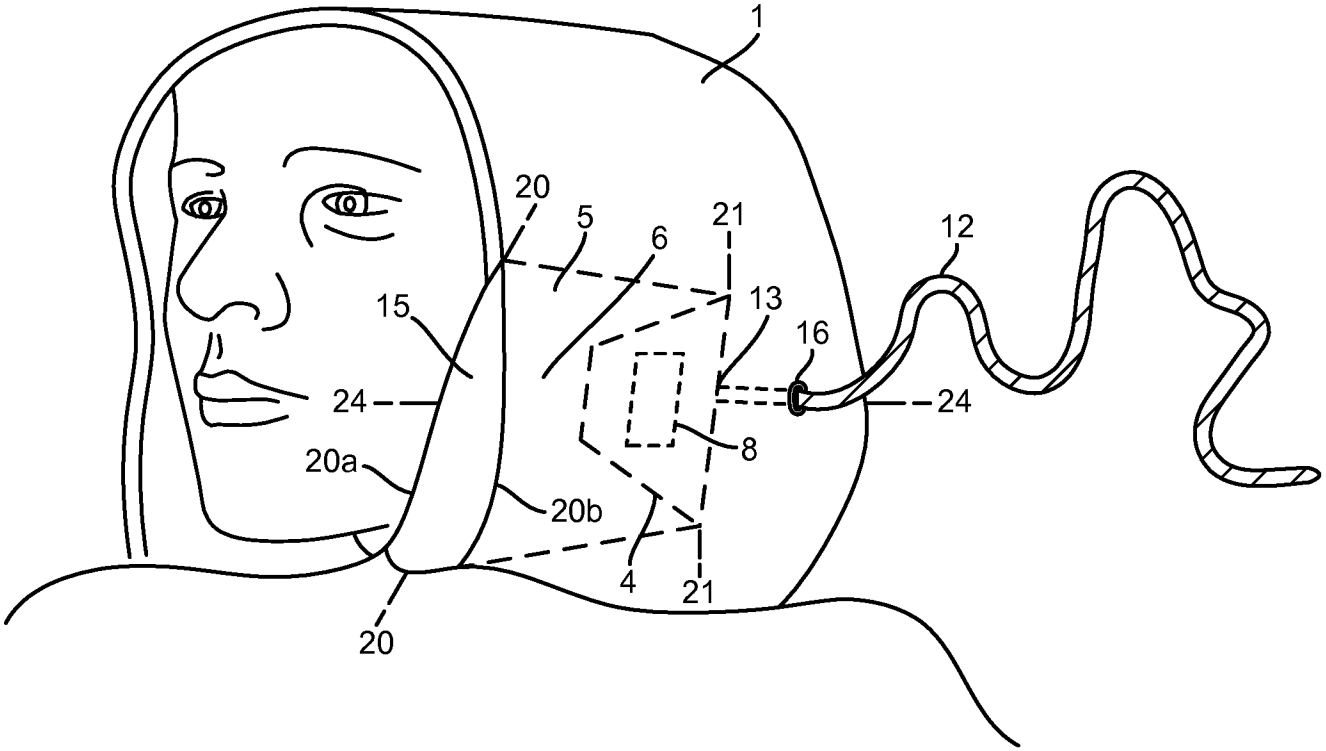
Figure 3:
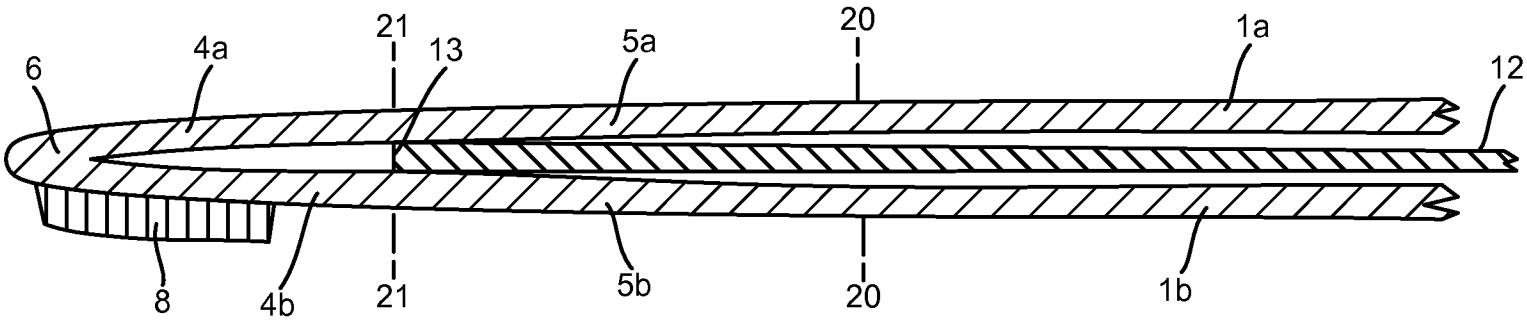
Figure 4:
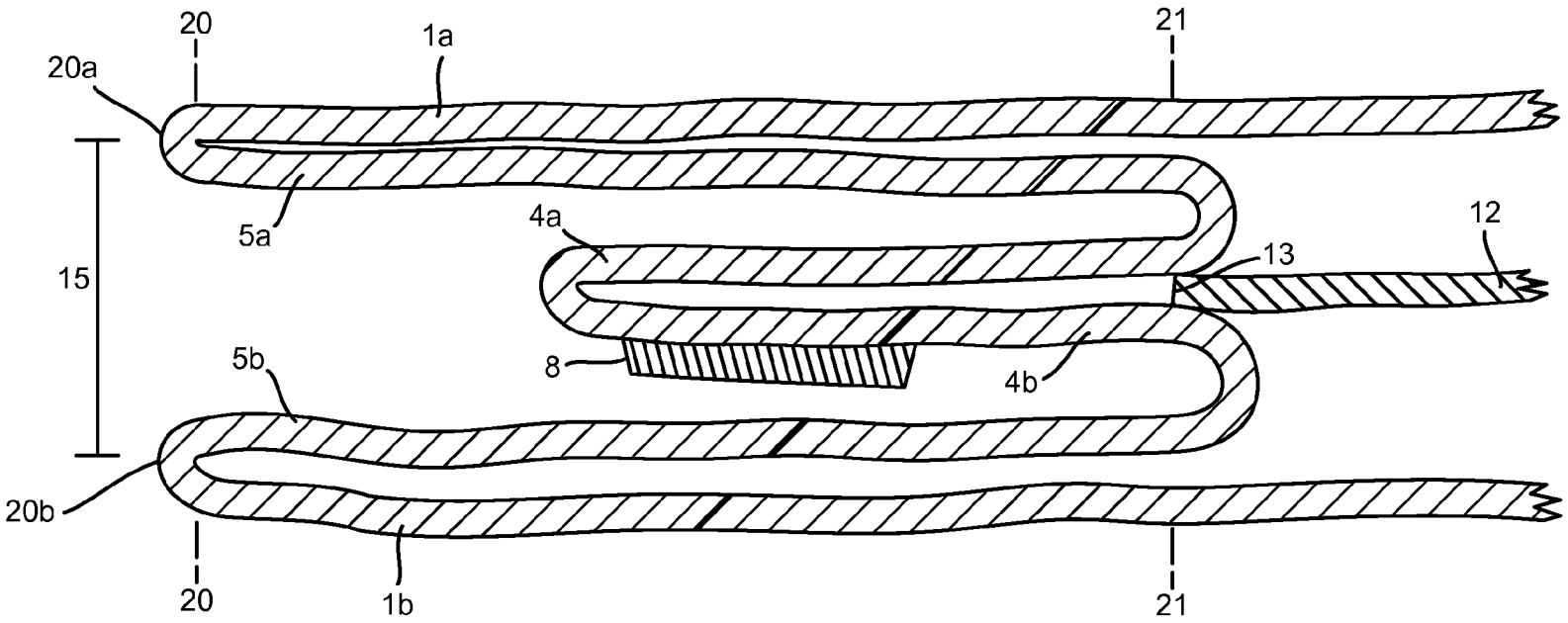

Referring now to the drawings, there is shown in FIGS. 1-4 a first embodiment of an article of apparel that is a hooded sweatshirt with a hood 1 and an extension of material 6 which has its origin stemming from hood 1, which extends outward and over the face, as seen in its first open position as shown in FIG. 1. Extension area 6 and hood 1 are constructed of a dual layered material as shown in FIGS. 3 and 4. Operably secured or attached between the dual layers of material 6 at contact point 13, is retention mechanism 12, which passes through the dual layers of extended material 6, then through the dual layers of hood 1, and then exits headwear 1, through grommet 16. Grommet 16 may be situated at any position on headwear 1. Grommet 16 may also be situated in a pocket of the hooded sweatshirt, so that the retention mechanism 12 passes through hood 1, where it travels through the body of the sweatshirt and exits through the pocket. It is also possible that the dual layers of extension material 6, may be attached to a separate container or capsule which can be attached to a helmet, or to an item of headwear such as a winter hat.

Contact Point 13 divides up extended material 6 into two parts, outer area 4 and inner area 5, by means of area 21. Here the retention mechanism is a string. It is possible that the retention mechanism may also be a strap or a band. It is also possible that the retention mechanism may begin as a strap, and continue into a string.

Attached to the inner area of extension area 4 is a Velcro® tab 8, which when material 6 is extended across the face, attaches to an alternate Velcro® tab positioned either internal or external to headwear 1, on the opposite side of headwear 1 (not shown). Velcro® tab 8 may also be attached to the outer area of extension area 4. As used herein, Velcro® may refer to hook and loop fasteners or components of those types of fasteners.

In use, as shown in FIG. 2, the wearer detaches Velcro® tab 8 from its alternate attaching means on the opposite side of headwear 1, then grabs retention mechanism 12 and pulls it out and away from his head through grommet 16, causing extended material 6 along area 20 to fold inside the hood forming natural pocket 15.

Inside of pocket 15, extended material 6 is prevented from folding or being pulled further inward past area 21 as contact point 13 is not allowed to be pulled further into the hood as the length of material area 5 and its connection to the material of hood 1 at area 20 prevents it, thereby leaving excess material 4 which houses Velcro® tab 8, to rest inside pocket 15 in a stable and stored position. It is also possible when extended material 6 is retracted into hood 1, Velcro® tab 8 may attach itself to an alternate attaching means situated external to natural pocket 15.

When it is desired to have extended material 6 cover one's face, the wearer reaches inside pocket 15, grabs material 4 and pulls it out of pocket 15, unfolding and extending it over his face, and then reattaches Velcro® tab 8 to the alternate side of his headwear at a cooperating means, as is shown in FIG. 1.

It is also possible to have material 6 fold on area 20 and remain inside the hood, whereas retention mechanism 12 would then be connected to an area external to extension 6. It would then pass through an area or an external loop situated on the inside of headwear 1. In this case, it is also possible to have a pocket built into the inside of headwear 1, so that material 6, when folded inside of headwear 1, will rest more securely in place.

It is also possible that natural pocket 15, may be positioned inward from the frontal opening of hood 6.

FIG. 3, which depicts a cross-section across the line 24 shown in FIG. 2, shows material 6 extended outward in front of the face and how it is connected to headwear 1, which begins after fold area 20. Retention mechanism 12 is attached at point 13 between the dual layers of material 6 at area 21 by means of contact point 13, forming areas 4 and 5 of extended material 6. Material area 4 is now split into layers 4*a* and 4*b*, material 5 is now divided into layers 5*a* and 5*b*, and material 1 is now split into layers 1*a* and 1*b*. Material areas 1*a*, 5*a*, 4*a*, 4*b*, 5*b*, and 1*b* may exist as one continuous piece, formed from at least one piece of continuous material. This one-piece continuous construction of material may exist in all extensions mentioned herein.

FIG. 4 shows a cross section 24 from FIG. 2, showing material 6 when it is folded along areas 20 and 21, and resting between the dual layers of headwear 1*a* and 1*b*, after retention mechanism 12 has been pulled out and away from the hood through grommet 16 (as seen in FIG. 2), which forms pocket 15 designated by corners 20*b* and 20*a*. It is possible that a closure mechanism such as Velcro® or button snaps may be attached to the inner portion of pocket 15 on the surface on areas of 5*a* and 5*b*, so that pocket 15 may be selectively opened or closed. It is also possible that a stitch may be sewn through material 5*a* and 1*a* or 5*b* and 1*b*, forming a natural channel, so that a string may pass through this channel, which can then be used to selectively tighten or loosen the fit of hood 1.

Figure 5:
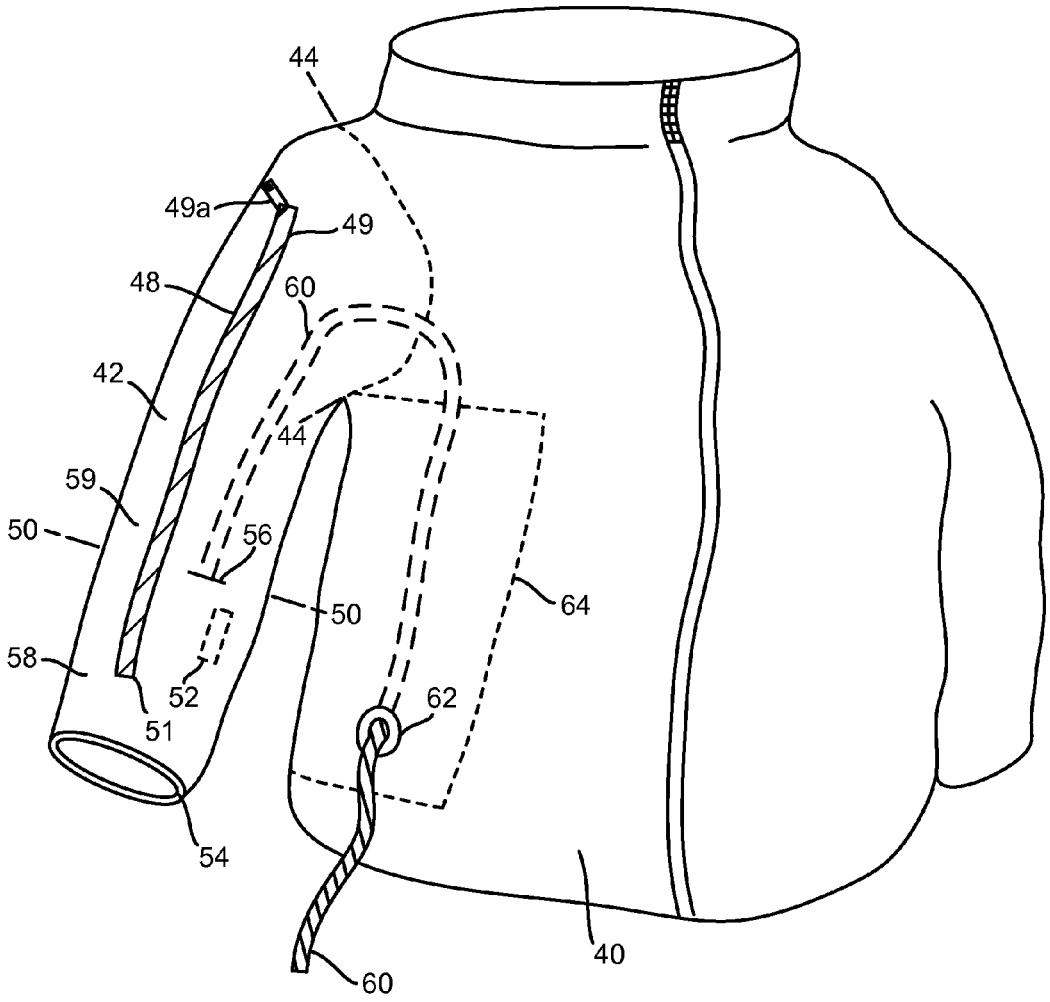
FIGS. 5-7 illustrates an embodiment of an article of apparel when the retractable extension is the sleeve of a jacket.
Figure 6:
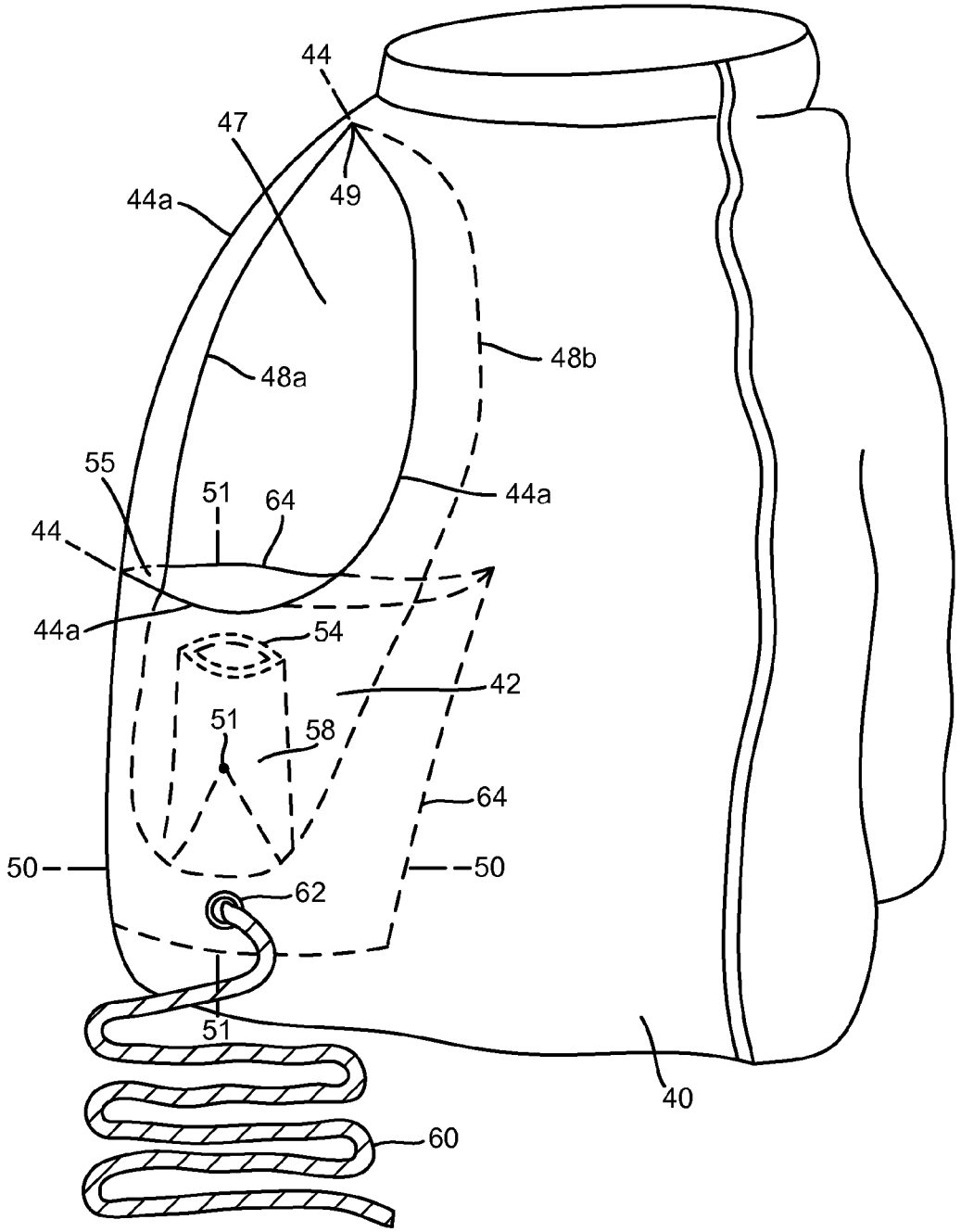

FIGS. 5 and 6 show the invention when it is utilized in the form of a jacket or shirt 40. Shirt 40 has a full-length arm extension 59, which begins at area 44. Arm 59 is divided by area 50 into a lower portion 58 and an upper portion 42. Zipper pull 49*a* rests at the upper closed end of zipper 49, which runs from the top portion of sleeve 59 at end point 49 and extends downward to the lower end of sleeve 59 to end point 51. Rounded cuff 54 designates the end of sleeve 59 where the sleeve is open for a hand to fit through.

Retention mechanism 60 is operably secured to the inner surface of sleeve 59 at point 56, which also designates where sleeve 59 divides into its two areas 58 and 42. Beginning at contact point 56, retention mechanism string 60 travels through the inside of sleeve 59, passing up through area 44, then down the right side of jacket 40 entering the top open side area of pocket 64, and exiting jacket 40 through grommet 62. Grommet 62 and pocket 64 may be situated at any position within jacket 40. The bottom portion of pocket 64 may be opened or closed, and pocket 64 may be constructed of a mesh material if desired or of any fabric. A layer of material may be added within sleeve 59, with both sides open to cover the exposed retention mechanism 60.

In use, with his left hand, the wearer reaches over to sleeve 59, and grabs zipper pull 49*a*, and pulls it downward from point 49 to point 51, thereby opening the sleeve. He then pulls his right hand up through opening 54, and sticks it out of the open hole that is left open formed by zipper 48 being opened. With his left hand he now grabs hold of retention mechanism 60 and pulls it out and away from the main body portion, thereby causing sleeved 59 to be retracted into the jacket 40, whereby sleeve 59 is now folded into itself and rests on the inside of jacket 40 within pocket 64, also forming natural pocket 55, which lies inside of pocket 64 as shown in FIG. 6. The lower portion of sleeve 59, area 58 is now folded along area 50. Sleeve 59 is now divided into two separate edges 48*a* and 48*b* tucked within jacket 40, allowing arm hole 47, now depicted by outer edge 44*a*, to form. Edge 44*a* is continuous around arm hole 47. It is also possible that edges 48*a* and 48*b* may be temporarily secured to the interior of jacket 40 by means of Velcro® or button snaps. In FIG. 6, the attachment point of string 60 to sleeve 59 at point 56 is not shown.

When the user desires to put the sleeve to use, with his left hand he reaches into pocket 55, grabs hold of sleeve 59 at its edge 54, and pulls sleeve 59 out of pocket 64 through arm hole 47 thereby causing string 60 to retract through grommet 62 and once again extend itself within jacket 40 along the inner area of sleeve 59. When sleeve 59 is outside of jacket 40, the user then takes his right hand and slides it back through hole 54, and then with his left hand he takes the zipper 49*a* and moves it upward from point 51 to point 49, thereby closing his right arm within the sleeve.

Tab 52 is situated on the lower portion of sleeve 59, and may be used if retention mechanism 60 were not present. In this case, after opening zipper 48 with his opposite hand and sliding his arm through the opening, the wearer with his left hand, would then open the front zipper of jacket 40 and reach through the lower portion of pocket 64 (now open), past area 44, and reach into sleeve 59 grabbing hold of tab 52, and then pull tab 52 inside through area 44 and into pocket 64, where the sleeve would rest until needed. It is also possible, that an opening may be situated on the lower portion of area 44 around the armpit area of the jacket, and that tab 52 would be positioned external to sleeve 59. In this case, from the interior of jacket 40, the wearer would stick his arm through this opening, reach for tab 52 on the outside of sleeve 59, and pull sleeve 59 into the interior of jacket 40, where he would then manually fold it into pocket 64. From the inside of jacket 40, he may also reach through the bottom open portion of pocket 64, then out through the opening at the armpit area, grab external tab 52, and then pull it back into pocket 64, thereby retracting sleeve 59 into pocket 64 where it would rest until needed. It is also possible to implement the two aforementioned embodiments into the other extensions and body portions mentioned herein.

Figure 7:
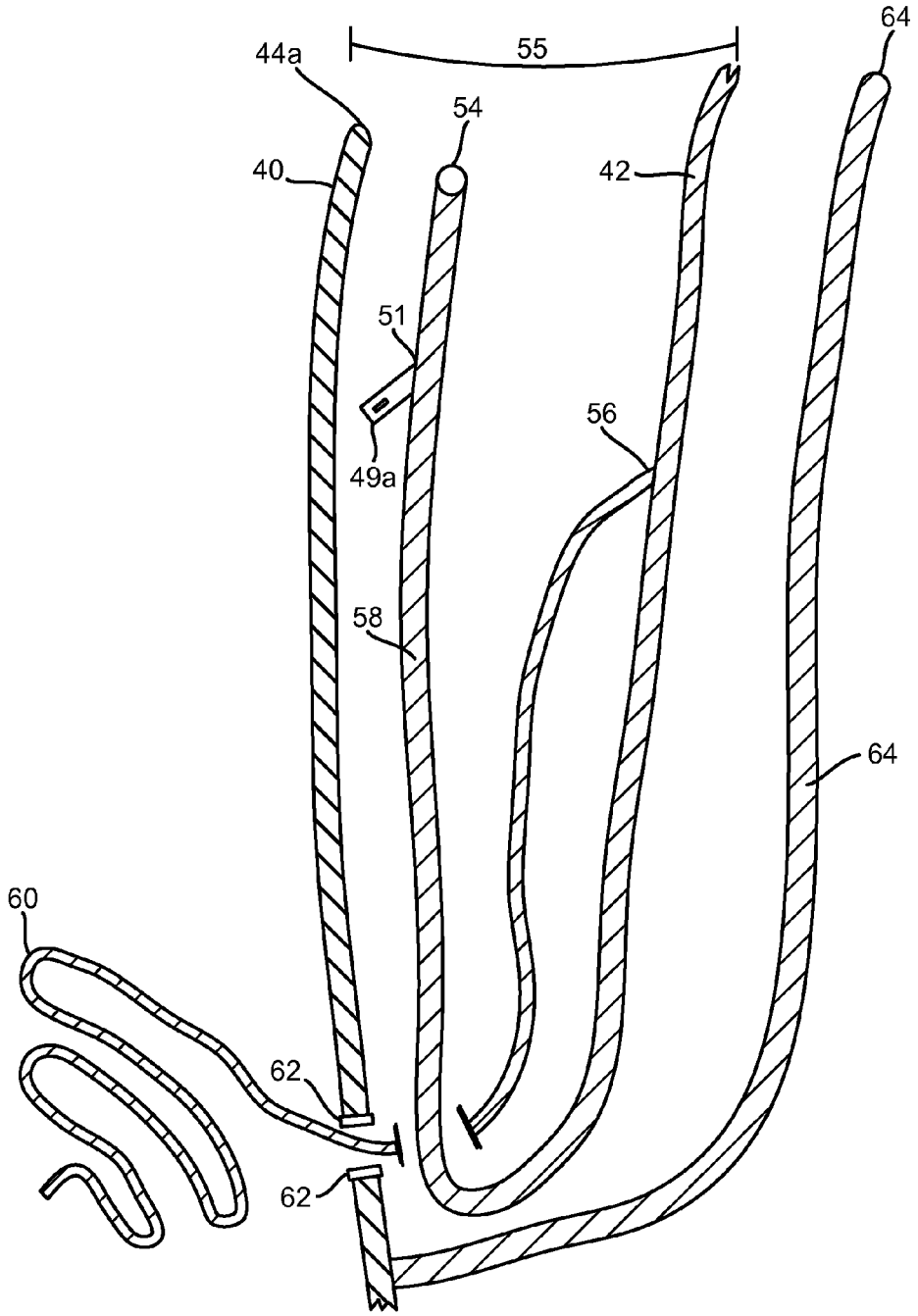

FIG. 7, which is a cross-section along the line 51 from FIG. 6, shows in further detail natural forming pocket 55 designated by rounded edge 44*a* of jacket 40 and inner surface area 42, which houses zipper 51, and the end of sleeve 54. Retention string 60 is attached to the inner surface of area 42 at point 56, where it then passes through the opening in area 58 (which is left open, as zipper 48 is open), and then passes out of jacket 40 by means of grommet 62. Pocket 64 further houses sleeve 59 as it is folded into its parts.

Regarding FIGS. 5-7 it is possible that the embodiment shown therein be situated in any position within jacket 40. Zipper 48 may be situated at any position on sleeve 59, and retention mechanism 60 may be attached at any internal point within sleeve 59. If opening 48 were to be situated to the rear of sleeve 59, then sleeve 59, when opened and retracted into jacket 40, would then be tucked into a self made storable pocket which would be situated on the upper frontal portion of jacket 40.

Figure 8:
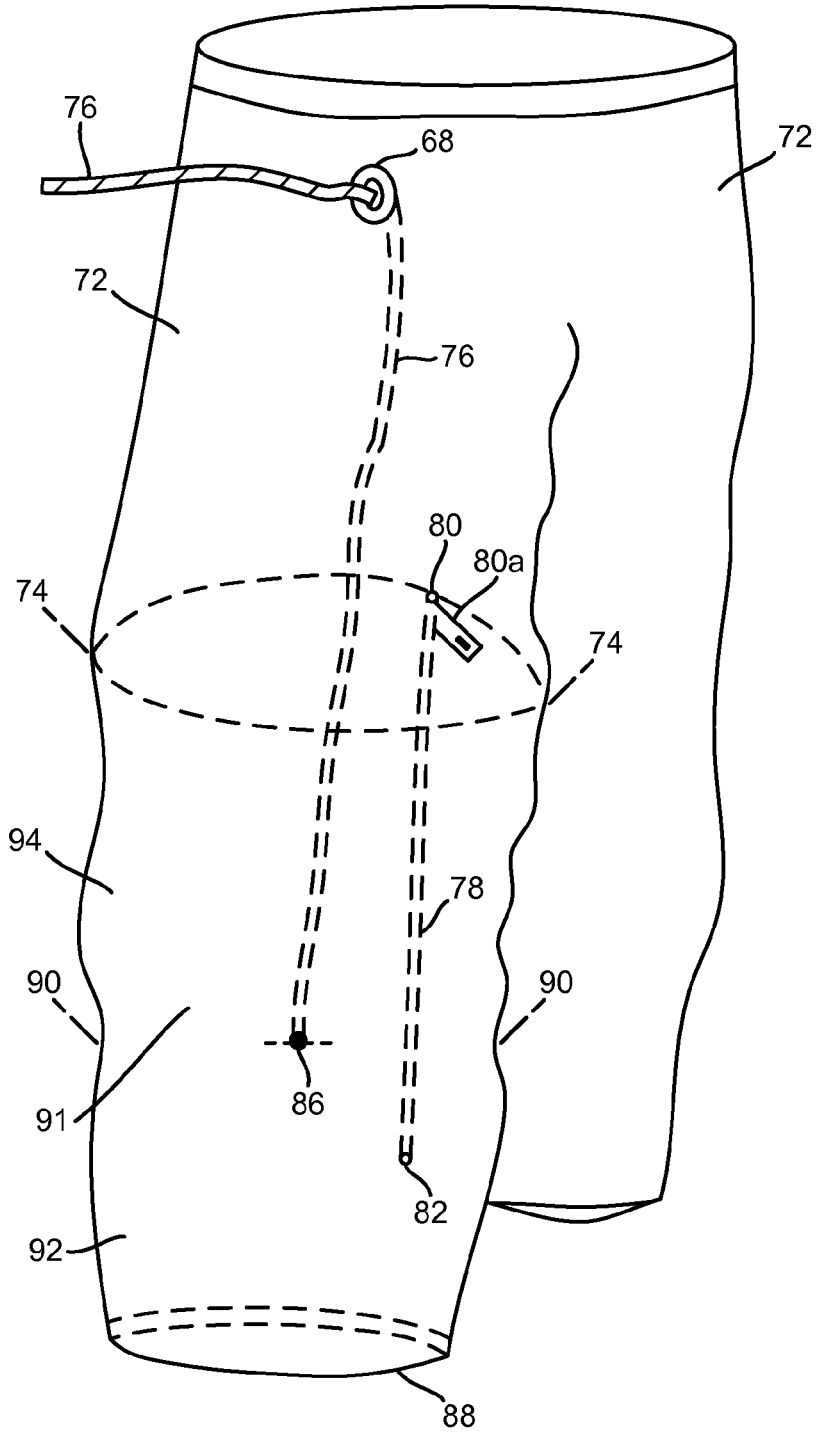
FIGS. 8 and 9 illustrate another embodiment of an article of apparel when the retractable extension is the lower portion of a pant leg.

FIG. 8 shows another embodiment of the invention in the form of a pant. Here is shown main pant 72, which continues past area 74 into a leg portion 91. Leg portion 91 is divided into upper areas 94 and a lower leg area 92 by means of horizontal area 90. The lower leg portion 92 ends by cuff 88. On the inside of leg portion 91 is a zipper closure 78 with zipper pull 80*a* attached. Zipper 78 begins at point 80 situated on horizontal area 74 and travels down to point 82. Also situated on the interior of and attached to leg portion 91 at point 86 is retention mechanism 76 which passes up through leg portion 91, then area 74, then through pant 72, and exits pant 72 via means of grommet 68.

Figure 9:
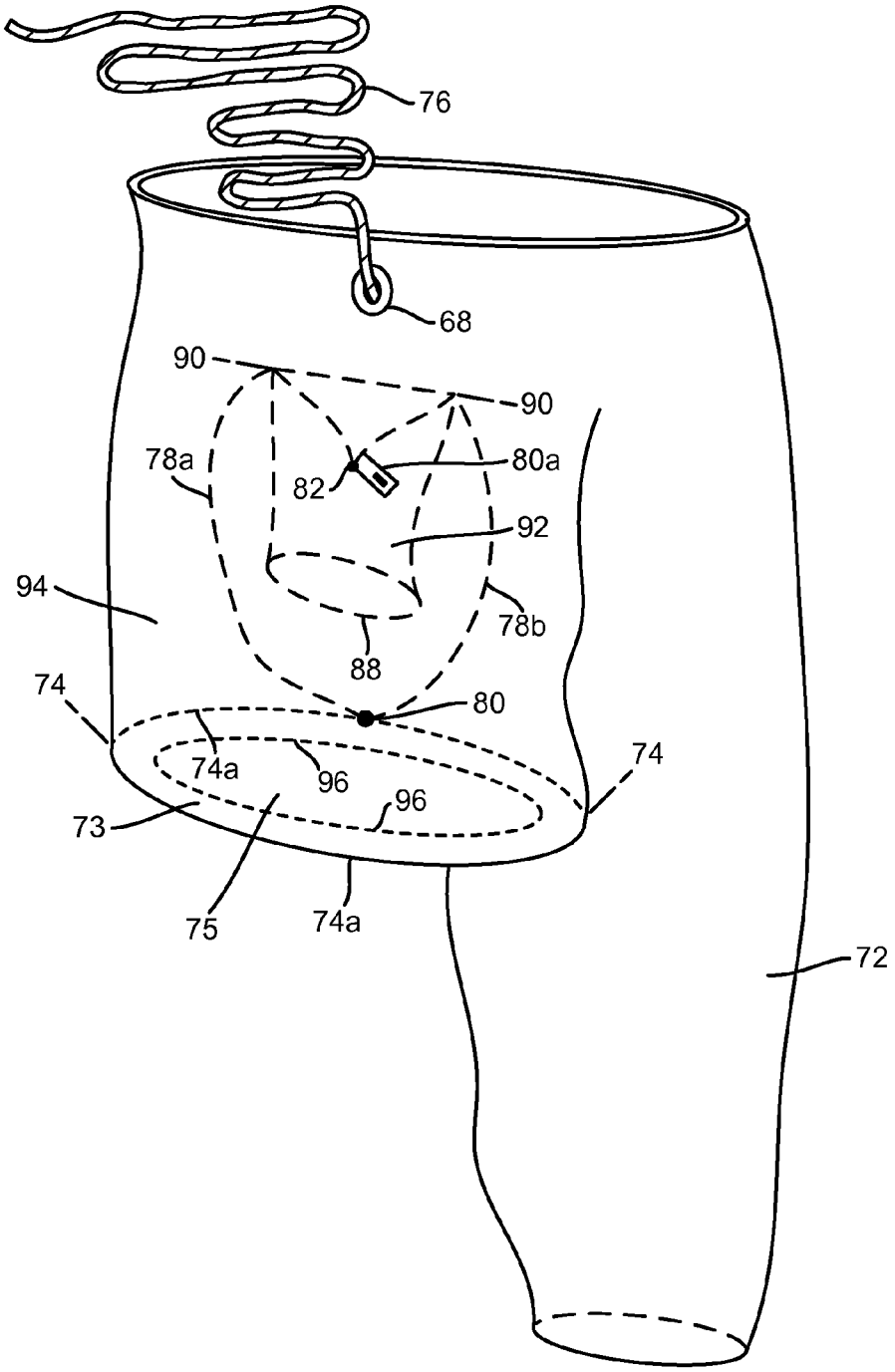

In use, and as seen in FIG. 9, the wearer unzips zipper 78 into edges 78*a* and 78*b* by grabbing zipper pull 80*a* and sliding it down to point 82. He then slides his right foot through hole 88, so that it is external to pant leg 91. He then, with his hand, takes hold of retention mechanism 76 and pulls it out and away from his body thereby causing pant leg 94 to fold into itself at area 74 as well as area 90, creating a new outer edge of a pant leg 74*a* and hole 75 which the users' leg now sticks through inner material 96 and outer edge 74*a* create a pocket 73 where pant leg 91 now rests. It is possible that an attaching means such as Velcro® or button snaps may be added to the inner surface of material 96 and to the inner surface of pant leg 72 close to the edge of 74*a* to material 96, so that when pocket 73 is closed, pant leg 91 will be secured within pocket 73.

To extend the pant leg, the wearer reaches inside pocket 73 grabs pant leg 91 by its edge 88 and pulls the pant leg down so it is fully extended, takes his foot and steps back into the pant leg through hole 88, and then he brings zipper pull 80*a* from point 82 back up to point 80, completing the pant again. As the pant leg is being dropped out of pocket 73, retention mechanism 76 is retracted back into the pant.

Figure 10:
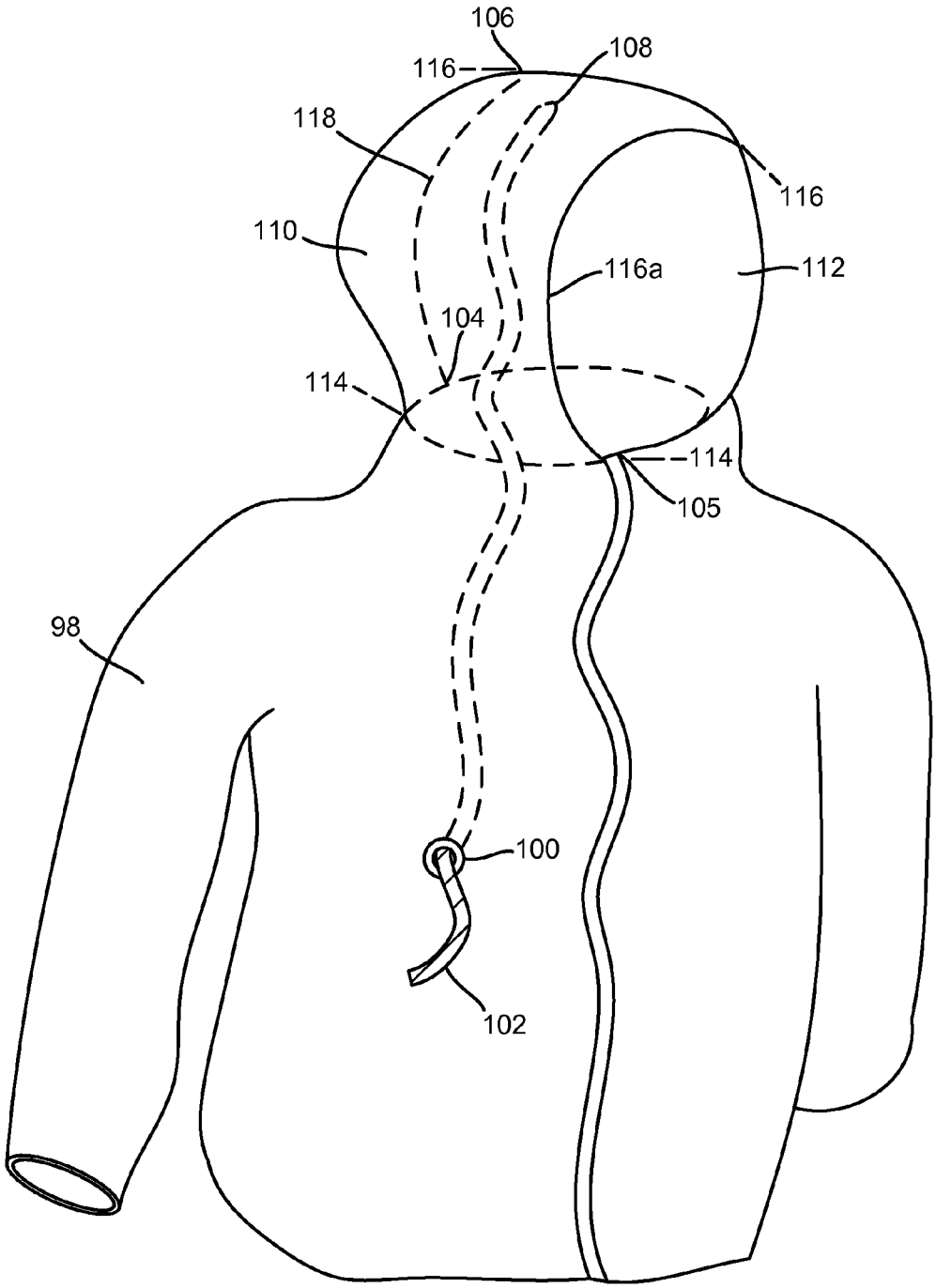
FIGS. 10-12 illustrate yet another embodiment of an article of apparel when the retractable extension is the hood of a jacket.

FIG. 10 shows another embodiment of the invention, wherein a hood 110 is attached to main jacket 98. Both hood 110 and jacket 98 are made from dual layered material. Retention mechanism 102 begins on the outside of jacket 98, travels through grommet 100, through the inside of the dual layers of 98 up the chest portion past the neck at area 114 and then attaches itself to hood 110 at contact point 108 which is horizontally lined up with area 116. In the rear of hood 110 is a slit 118 that is separably detachable from point 104 to 106. Area 112 depicts an opening for the face.

On the far side of area 114, beginning from point 104 and stretching horizontally to the wearer's left to point 105, hood 110 is separably detachable to main jacket 98 by means of Velcro®, magnets or the like.

In use the wearer first opens the rear of hood 110 by separating slit 118 from points 104 to 106. He then takes the far side of hood 110 from points 104 to 105 and separates the Velcro® tabs from the main jacket 98. Then he grabs retention mechanism 102 and pulls it out and away from his body thereby pulling hood 110 into the body portion of jacket 98 as seen in FIG. 11.

Figure 11:
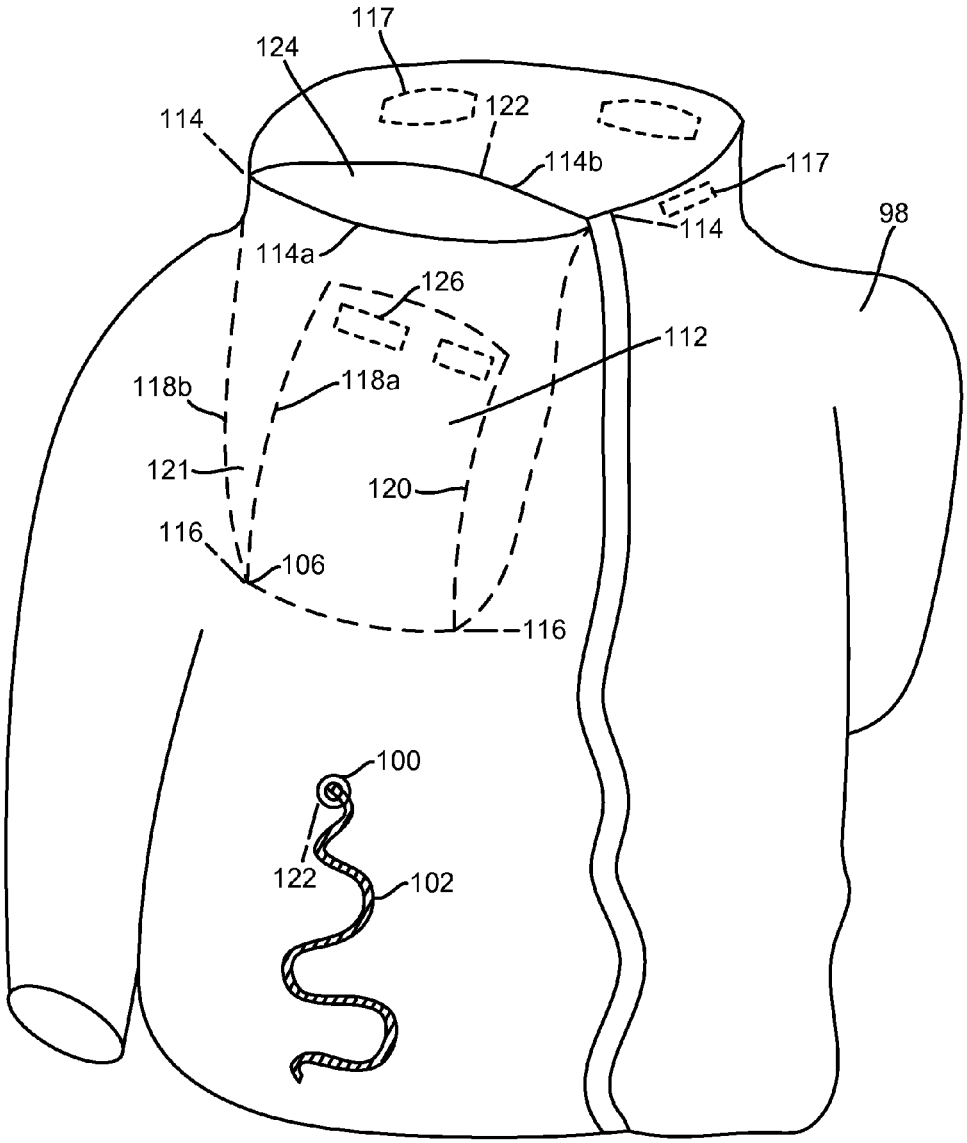

In FIG. 11 it is shown in more detail, how hood 110 is stored. Slit 118 has now divided into two separate edges 118*a* and 118*b*. Hood 110 has now also been divided into two portions 121 and 112 by fold area 116. Area 114 is now an opening 124, depicted by inner layer 114*b* and outer layer 114*a*. Attaching means 117 and its alternate attaching means 126 situated on the lower portion of hood 110 now depicted by area 112 within the self-storable pocket 124, are now shown.

Velcro® tabs 117 and 126 are separably detachable when the hood is exposed and in use. Therefore, in use the wearer reaches into hole 124, grabs hood 110 at area 112, pulls it out and over his head, and attaches Velcro® tabs 126 to the alternate Velcro® tabs 117. As he pulls the hood out of the pocket, retention mechanism 102 retracts back into the main jacket 98 through grommet 100. The user then reattaches edge 118*a* to 118*b* to once again form the seal of 118.

Figure 12:
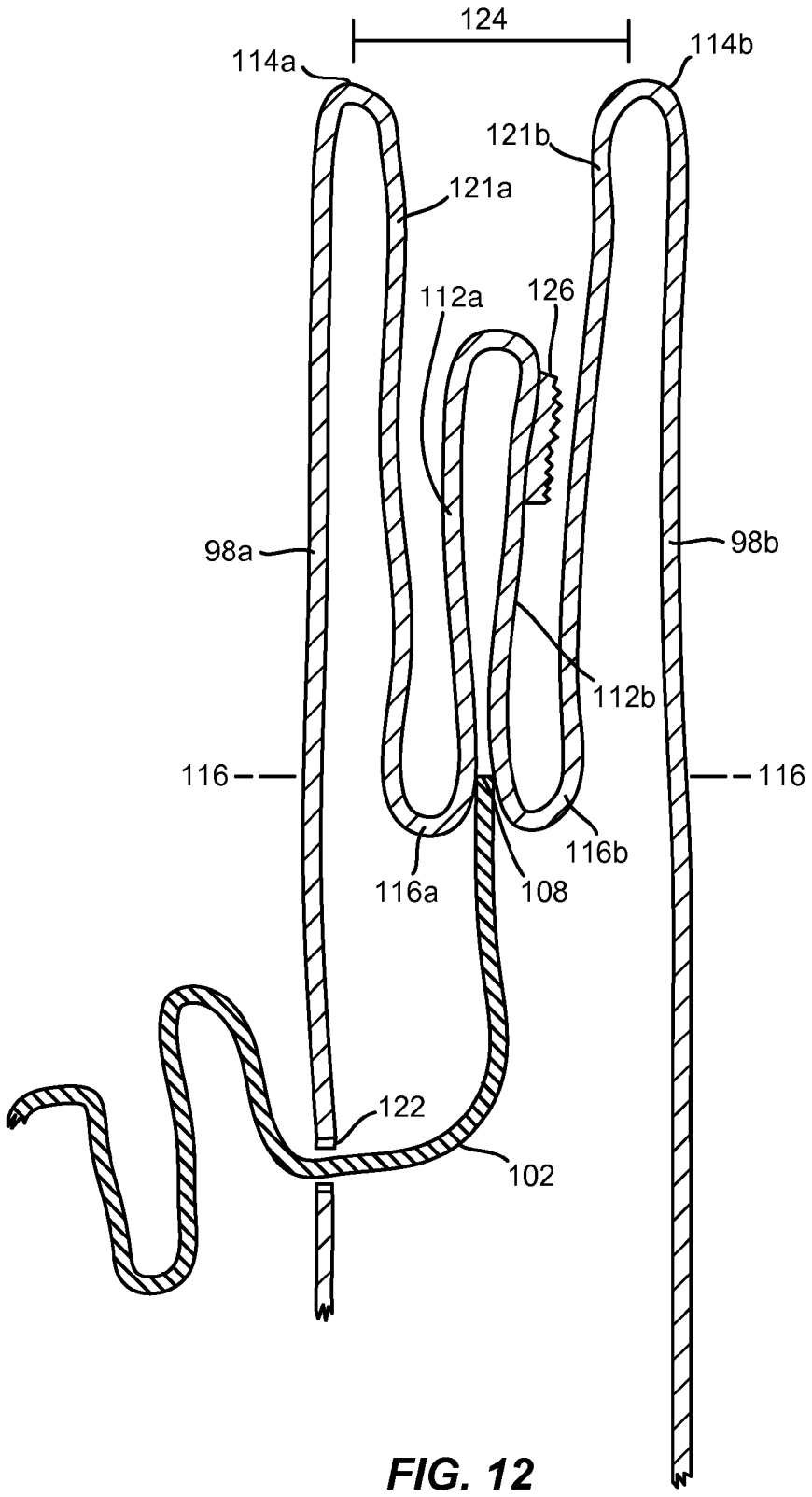

FIG. 12 shows a cross section along line 122 shown in FIG. 11. The dual layers of jacket 98 are now depicted by outer layer 98*a* and inner layer 98*b*. The top rounded corners of 114*a* and 114*b* form pocket 124 which houses hood 110 when it is broken down into its two folded parts 112 and 121. The portions of hood 121 now create two layers 121*a* and 121*b*, which create a pocket for the dual layers 112*a* and 112*b* to rest between. Retention mechanism 102 attaches itself between layers 112*a* and 112*b* at contact point 108, where the curved corners 116*a* and 116*b* are formed as retention mechanism 102 cannot be pulled further out of jacket 98, due to the fact that the size restriction of inner and outer material 98*a* and 98*b*, will not allow hood 110 to be pulled further into the self-storing pocket 124.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, methods of use, embodiments, and combinations thereof are also possible. Therefore the spirit and scope of the appended claims should not be limited to the description of the embodiments contained herein.

What is claimed is:

1. An article of apparel, including a shirt or a jacket, comprising:

a body portion having a storage region and an extension portion;

the extension portion normally positioned in an open position, wherein the extension portion extends from the body portion in the open position; and a retention mechanism secured to an interior of the extension portion, the retention mechanism extending from the extension portion and protruding from the interior of the extension portion and through a part of the body portion, wherein at least a portion of the retention mechanism protruding through the part of the body portion pulls the extension portion from the open position to a storage position to store the extension portion within the storage region.

2. The article of apparel of claim 1, wherein said retention means comprises a string.

3. An article of apparel, including a shirt or a jacket, comprising:

a body portion having a storage region formed therein and an extension portion;

the extension portion normally positioned in an open position, wherein the extension portion extends from the body portion in the open position; and a retention mechanism secured to the extension portion, the retention mechanism extends from an interior of the extension portion and passes through the interior of the extension portion and a region of the body portion, wherein at least a portion of the retention mechanism passing through the region of the body portion pulls the extension portion from the open position to a storage position to store the extension portion within the storage region.

4. The article of apparel of claim 3, wherein said retention means comprises a band that can be transformed into a string.

5. The article of apparel of claim 3, wherein said retention means comprises a band.

6. The article of apparel of claim 3, wherein the article of apparel is a jacket and the extension is a sleeve.

7. An article of apparel, including a shirt or a jacket, comprising:

a storage region;

an extension portion normally positioned in an exposed position, the extension portion having an opening, the opening allows passage of a portion of a body of a user of the article of apparel; and a retention mechanism secured to an interior of the extension portion, the retention mechanism extends from the interior of the extension portion and through a body portion of the article of apparel, wherein at least a portion of the retention mechanism extending from the body portion of the article of apparel moves the extension portion from the exposed position to a stored position to store the extension portion within the storage region.

8. The article of apparel of claim 7, wherein the article of apparel is a jacket or a shirt, and the extension portion is a sleeve of the jacket or the shirt.

9. An article of apparel, including a shirt or a jacket, comprising:

a body having a first opening and an extension portion;

a storage region formed in the body;

the extension portion normally positioned in an exposed position, the extension portion having a second opening allowing passage of a portion of a body of a user of the article of apparel; and a retention mechanism secured to an interior of the extension portion, the retention mechanism extends from the interior of the extension portion and passes through the first opening, wherein by passing through the first opening, the retention mechanism moves the extension portion from the exposed position to a storage position to store the extension portion within the storage region.

10. The article of apparel of claim 9, wherein the extension portion is a sleeve of the jacket or the shirt.

11. An article of apparel, comprising:

a storage region located in an interior portion of the article of apparel;

an extension portion having a first position and a second position, wherein, in the first position, the extension portion is stored within the storage region and, in the second position, the extension portion is positioned external to the storage region and extends from the article of apparel;

the extension portion having an opening, the opening allows passage of a portion of a body of a user of the article of apparel;

a tab secured to the extension portion, wherein the extension portion is moved from the second position to the first position through the opening in the extension portion by pulling the tab into the interior portion of the article of apparel, the extension portion is moved from the first position to the second position through the opening in the extension portion by pulling the extension portion away from the interior portion of the article of apparel.

12. The article of apparel of claim 11, wherein the article of apparel is a jacket or a shirt and the extension portion is a sleeve of the jacket or the shirt.

13. A self-storing pocket on an article of clothing, including a shirt or a jacket, the article of clothing including a body portion;

an extension portion having an open position, wherein the extension portion extends from the body portion in the open position; and a retention mechanism secured to an interior of the extension portion, the retention mechanism extends from the interior of the extension portion, wherein at least a portion of the retention mechanism protruding through a part of the body portion moves the extension portion from the open position to a storage position to store the extension portion within the body portion in a folded configuration;

the self-storing pocket comprising:

at least a part of an interior wall of the body portion;

at least a part of the extension portion stored;

wherein the self-storing pocket is formed when the retention mechanism moves the extension portion into the storage position to store the extension portion within the body portion in the folded configuration.

14. The self-storing pocket of claim 13, wherein the article of clothing is a jacket or a shirt and the extension portion is a sleeve the jacket or the shirt.

* * * * *